US010711974B2

(12) United States Patent
Franck et al.

(10) Patent No.: US 10,711,974 B2
(45) Date of Patent: Jul. 14, 2020

(54) KICK REFLECTOR FOR WALL WASH APPLICATIONS

(71) Applicant: SIGNIFY HOLDING B.V., Eindhoven (NL)

(72) Inventors: Peter John Franck, Seekonk, MA (US); Mark Owen Jones, South Dartmouth, MA (US); Graham Michael Rippel, East Walpole, MA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/315,185

(22) PCT Filed: Jul. 3, 2017

(86) PCT No.: PCT/EP2017/066451
§ 371 (c)(1),
(2) Date: Jan. 4, 2019

(87) PCT Pub. No.: WO2018/007291
PCT Pub. Date: Jan. 11, 2018

(65) Prior Publication Data

US 2019/0162388 A1 May 30, 2019

Related U.S. Application Data

(60) Provisional application No. 62/358,744, filed on Jul. 6, 2016.

(30) Foreign Application Priority Data

Aug. 30, 2016 (EP) ..... 16186430

(51) Int. Cl.
*F21V 7/00* (2006.01)
*F21S 8/02* (2006.01)
*F21V 17/00* (2006.01)

(52) U.S. Cl.
CPC ..... *F21V 7/0033* (2013.01); *F21S 8/026* (2013.01); *F21V 7/00* (2013.01); *F21V 17/002* (2013.01)

(58) Field of Classification Search
CPC ..... F21V 7/0033; F21V 7/00; F21V 17/002; F21S 8/026
See application file for complete search history.

(56) References Cited

U.S. PATENT DOCUMENTS

| | | | | |
|---|---|---|---|---|
| 4,475,147 | A * | 10/1984 | Kristofek | F21S 8/026 362/147 |
| 4,564,888 | A | 1/1986 | Lewin et al. | |
| 5,800,050 | A | 9/1998 | Leadford | |
| 6,343,873 | B1 | 2/2002 | Eberhard et al. | |
| 6,350,047 | B1 * | 2/2002 | Ng | F21S 8/02 362/148 |
| 7,384,167 | B1 | 6/2008 | Gamache et al. | |
| 9,052,081 | B1 | 6/2015 | Paulsel | |
| 10,006,605 | B2 * | 6/2018 | Zhang | F21S 8/026 |

(Continued)

*Primary Examiner* — Mary Ellen Bowman
(74) *Attorney, Agent, or Firm* — Daniel J. Piotrowski

(57) ABSTRACT

Inventive methods and apparatus for providing an open wall wash luminaire designed to allow a small amount of light to go behind the luminaire kick reflector, resulting in the kick reflector being less noticeable by an occupant of the room when light is being provided by the luminaire.

15 Claims, 9 Drawing Sheets

(56) References Cited

U.S. PATENT DOCUMENTS

| | | | |
|---|---|---|---|
| 2004/0090784 | A1 | 5/2004 | Ward |
| 2007/0047235 | A1 | 3/2007 | Wilson |
| 2009/0059600 | A1 | 3/2009 | Steadman |

* cited by examiner

KICK REFLECTOR FOR WALL WASH APPLICATIONS

CROSS-REFERENCE TO PRIOR APPLICATIONS

This application is the U.S. National Phase application under 35 U.S.C. § 371 of International Application No. PCT/EP2017/066451, filed on Jul. 3, 2017 which claims the benefit of U.S. Provisional Patent Application No. 62/358,744, filed on Jul. 6, 2016 and European Patent Application No. 16186430.1, filed on Aug. 30, 2016. These applications are hereby incorporated by reference herein.

FIELD OF THE INVENTION

The present invention is directed to Inventive methods and apparatus for providing an open wall wash luminaire designed to allow a small amount of light to interact with the luminaire's kick reflector, resulting in the kick reflector being less noticeable in the ceiling opening.

BACKGROUND OF THE INVENTION

A typical recessed lighting fixture includes a frame, a reflector, a junction box and structure for attaching the frame to the ceiling. The frame includes an opening through which the reflector is employed to direct light to an area below the lighting fixture. In particular, a wall-wash reflector is employed to direct the light down at an angle away from the lighting fixture to illuminate a section of a wall. If a conventional downlight is placed near a wall, an arch results having light below and darkness above (as illustrated in FIG. 1). When several luminaires are placed at intervals along a wall, the end result is a series of these arches along the length of the wall being illuminated. The goal of a wall washer luminaire is to obtain a more even illumination on the wall, eliminating these arches and creating a more uniform wall appearance.

There are generally two prior art approaches to wall lighting from a ceiling mounting lighting fixture 210. The first is typically referred to as a lensed wall washer. This uses an angled lens 220 to diffuse the light as depicted in FIG. 2*a*. The advantage of this approach is that it provides good light coverage of the wall. However, it has several disadvantages:

1. The lens 220 is very bright, producing an amount of glare within the room that some people find objectionable.
2. As illustrated in FIG. 2*b*, the lighting fixture 210 has a different appearance than other recessed lights in the room. Designers prefer the wall washer fixtures near the walls to look similar to other downlights in the room.
3. The thickness of the cone cut on one end (item 230) typically results in a dark area at the top of the wall (approximately 2 inches below the plane 240 of the ceiling).

The second approach to wall washing is typically referred to as an "open wall washer." That is, it is open in the sense that there is no lens close to the ceiling aperture 310. As illustrated in FIG. 3*a*, such an open wall washer usually consists of two parts: (1) a downlight cone 320 that gives the same appearance when viewed from the room side, as a simple downlight not having a wall washing function; and (2) a "kick reflector" 330 that bulges out the side and "kicks" the light higher up the wall so that the wall illuminance is more uniform than a simple downlight. The advantage of this second approach is that it looks more like a simple downlight from the room side when people are looking at it.

However, it also has the disadvantage that the kick reflector bulge makes it more difficult to fit in a frame or housing. This is especially problematic with a double wall wash (for lighting the two walls of a hallway simultaneously with one luminaire) and a corner wall wash (for the corner of a room).

SUMMARY OF THE INVENTION

A possible solution to the problem of the bulge causing difficulty in fitting the light into a frame is to shrink the size of the downlight portion so that it is smaller than a standard downlight. However, when this is done, the flange width is different between the standard downlight cone and the wall wash cone. This result is objectionable to both designers and occupants of the room observing the light fixture from below.

Another solution, employed by various manufacturers, is to maintain the size and shape of the downlight cone, but attach the kick reflector to the inside rather than letting it bulge to the outside. This solution is illustrated in FIG. 4*a*. This eliminates the problem of the bulge not fitting through the frame or housing. However, the kick reflector blocks light of the opening, thus modifying the light coming out of the opening to something less than a clean circle as illustrated in FIG. 4*b*. (i.e., light is blocked by the kick reflector). Attempts to mitigate the visual appearance of the blocked area include painting of the bottom 410 of the kick white or vacuum-metalizing it as the same finish as the kick reflector surface. Such attempts do not truly overcome the problem of the light fixture being significantly different in appearance from simple recessed lights when viewed from below (as depicted in FIG. 4*b*).

U.S. Pat. No. 9,052,081 (2015 Jun. 9) relates to a magnetic kicker reflector that is installed within a reflector of a downlight fixture to create a "wall-wash" effect on one or more adjacent walls. The magnetic kicker reflector includes a proximal end, a distal end, a side surface extending from the proximal end to the distal end, and one or more magnets. The side surface includes an internal surface and an external surface. The magnets are coupled to or adjacent the external surface and faces substantially the same direction as the external surface. The proximal end, the distal end, and the side surface are formed having an arcuate length. The wall-wash assembly includes the kicker reflector, a reflector, and one or more bands coupled around and in contact with the outer surface of the reflector. The bands are in alignment with the magnets so that the kicker reflector is rotatable within the reflector and maintains attraction to the bands.

U.S. Pat. No. 4,475,147 (1984 Oct. 2) relates to a "wall wash" assembly for use with a ceiling mounted, recessed lighting fixture comprising a reflector housing having an open end, includes a ring member dimensioned for receipt in the open end of the reflector housing. A concentric ring segment is mounted on the ring member for movement 360° thereabout. An auxiliary reflector is mounted on the ring segment for movement therewith. Positioning of the auxiliary reflector by movement of the ring segment with respect to the ring member provides a desired "wall wash" illumination pattern. An optional baffle member is receivable on the ring member opposite the auxiliary reflector for blocking light emanating from the reflector housing to be excluded in the "wall wash" illumination pattern.

US 2007/047235 (2007 Mar. 1) relates to an apparatus that has a downlight cone defining a longitudinal axis and reflecting a portion of light from a light source to produce a scallop beam pattern on a surface. A window is defined by the downlight cone and has a zone that defines an angle that ranges from between specific degrees. The window includes another zone that defines another angle that is about 180 degrees. The window has a pair of symmetric contours that extends between the zones.

The present disclosure is directed to inventive methods and apparatus that provides a reflector that is completely inside the downlight cone, eliminating the problem of fitting into a frame or housing that the bulge reflector has. Further, the new approach allows some light to fall behind the reflector, either through a clear medium such as acrylic or with a floating reflector held off from the downlight reflector cone. This allows light both in front of the kick reflector and behind the kick reflector—resulting in the light from the fixture appearing similar to that of a conventional downlight when viewed from below.

BRIEF DESCRIPTION OF THE DRAWINGS

For a better understanding of exemplary embodiments and to show how the same may be carried into effect, reference is made to the accompanying drawings. It is stressed that the particulars shown are by way of example only and for purposes of illustrative discussion of the preferred embodiments of the present disclosure, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION

It is to be understood that the figures and descriptions of the present invention described herein have been simplified to illustrate the elements that are relevant for a clear understanding of the present invention, while eliminating, for purposes of clarity many other elements. However, because these omitted elements are well-known in the art, and because they do not facilitate a better understanding of the present invention, a discussion of such element is not provided herein. The disclosure herein is directed to also variations and modifications known to those skilled in the art.

Figure 5:
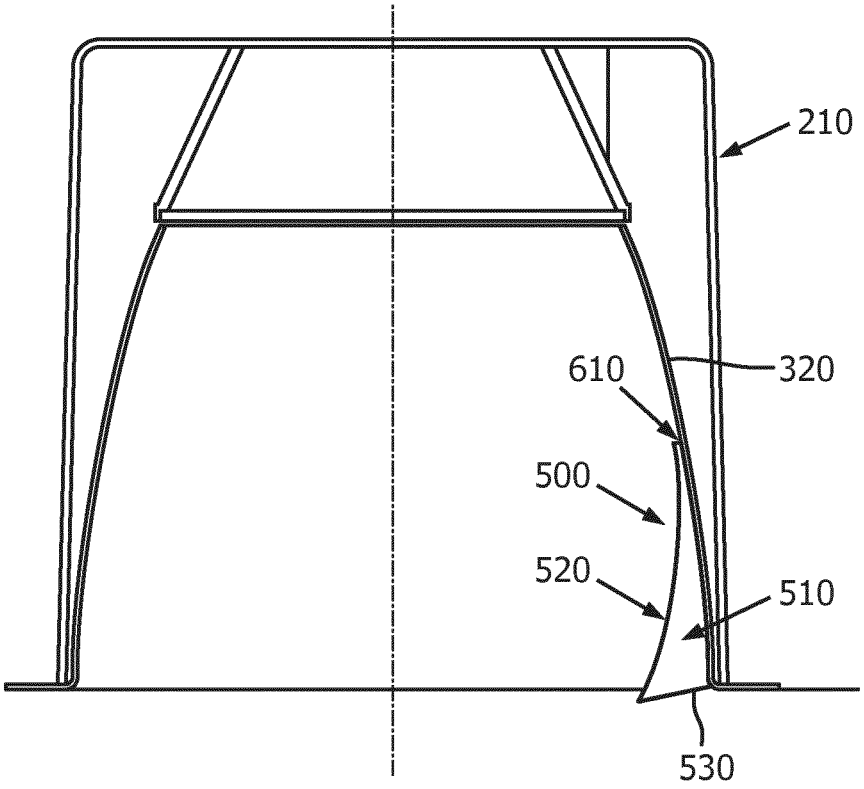
FIG. 5 illustrates an exemplary of the present invention wherein the kick reflector comprises a solid clear material.

FIG. 5 illustrates an exemplary light fixture of the present invention. The invention includes a kick reflector 500 which consists of a clear material 510 (such as Polymethyl Methacrylate (PMMA)). The kick reflector further comprises a front layer 520 that is anodized or otherwise made reflective on both sides—that is, on the front and back surfaces of layer 520. As depicted, the kick reflector 500 dips below the ceiling plane 240. In alternative embodiments, the kick reflector is set flush with the ceiling. In the embodiment depicted in FIG. 5, the body 510 of the kick reflector (i.e., the material behind the front layer 520) is a made of a solid clear material (e.g., an acrylic).

In additional embodiments, the bottom surface 530 of the kick reflector 500 could be smooth or have some surface texture to increase the brightness. Further, color could be added to body 510 or just to bottom surface 530 to create a decorative effect should such an effect be desired by the customer.

Figure 1:
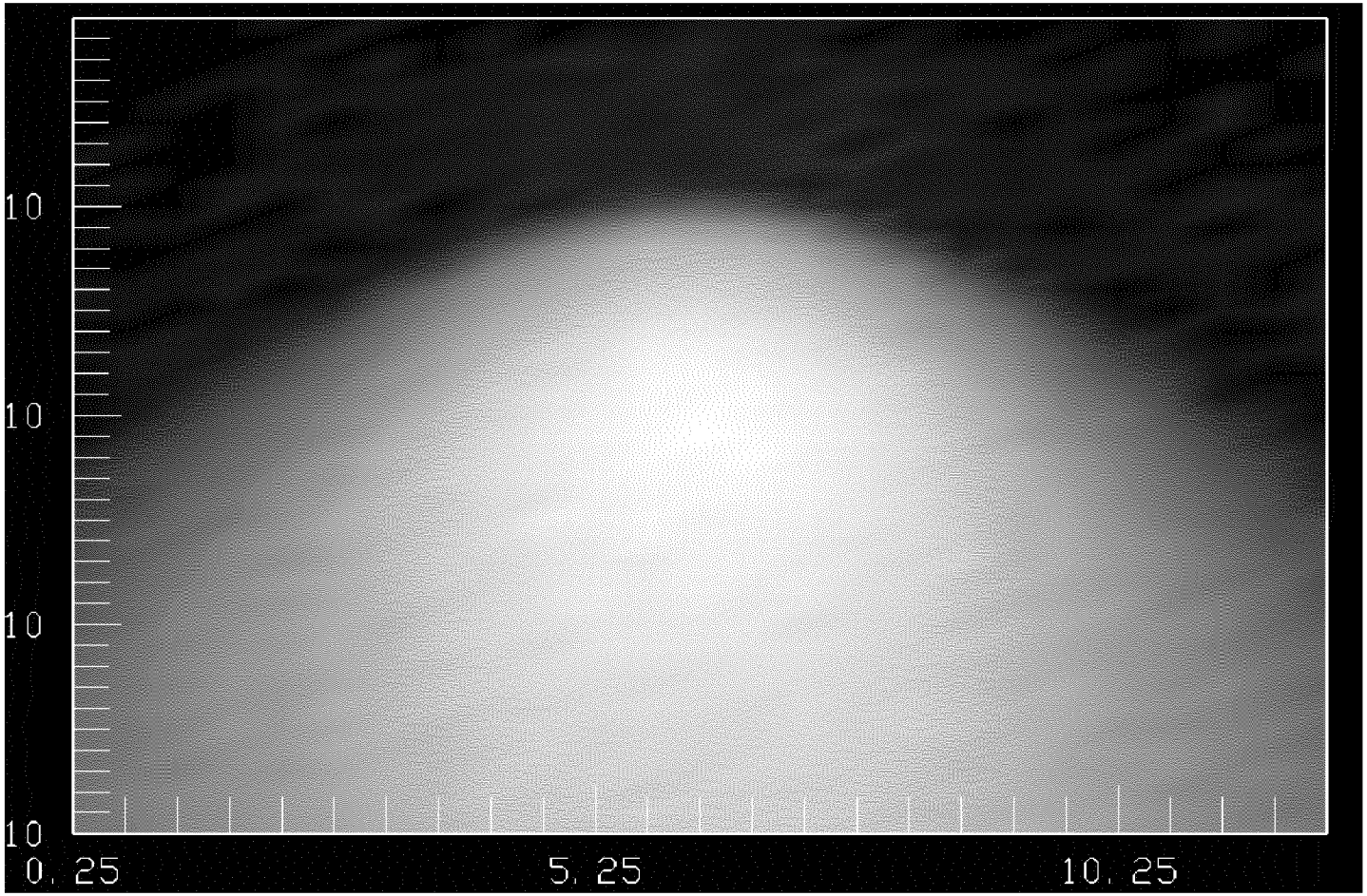
FIG. 1 illustrates a wall surface illuminated with a conventional ceiling light fixture.
Figure 2A:
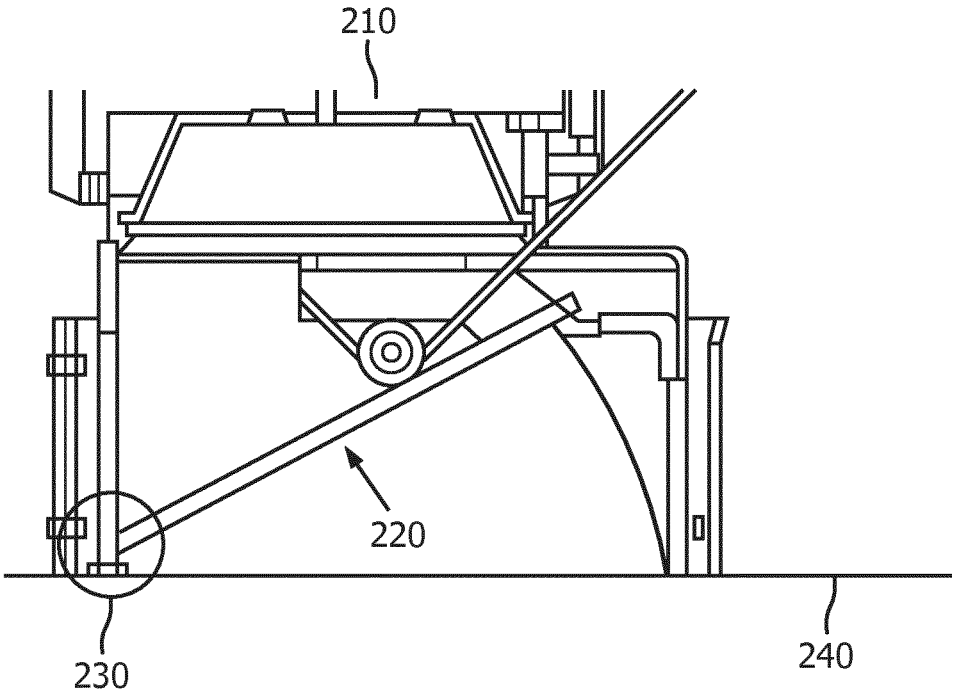
FIG. 2a Prior art
FIG. 2*a* is a perspective view of an exemplary prior art recessed luminaire which utilizes an angled lens to diffuse light onto a wall.
Figure 2B:
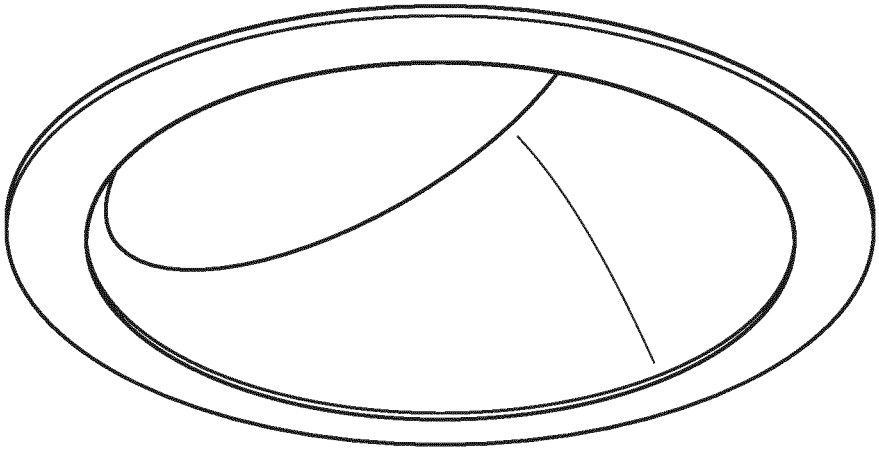
FIG. 2b Prior art
FIG. 2*b* illustrates the light fixture of FIG. 2*a* when viewed by an occupant in the room.
Figure 3A:
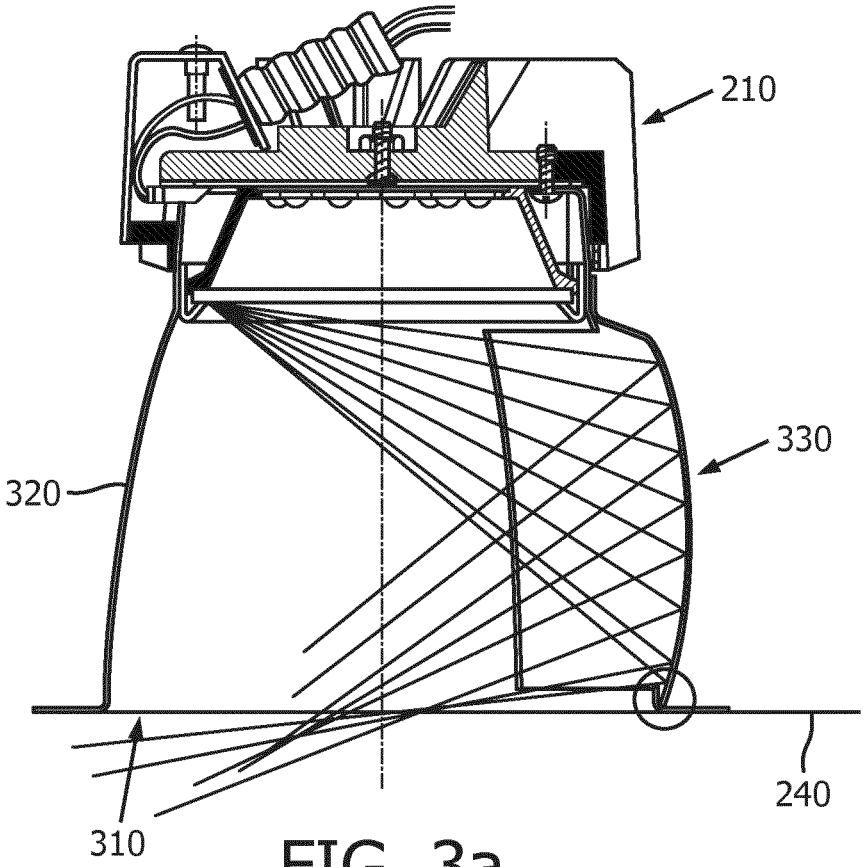
FIG. 3a Prior art
FIG. 3*a* is a perspective view of an exemplary prior art recessed luminaire which utilizes a kick reflector to diffuse light onto a wall.
Figure 3B:
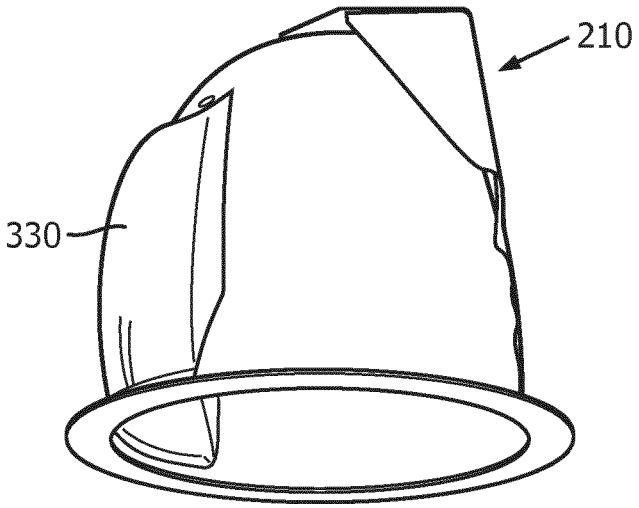
FIG. 3b Prior art
FIG. 3*b* illustrates the external appearance of the light fixture of FIG. 3*a;*
Figure 4A:
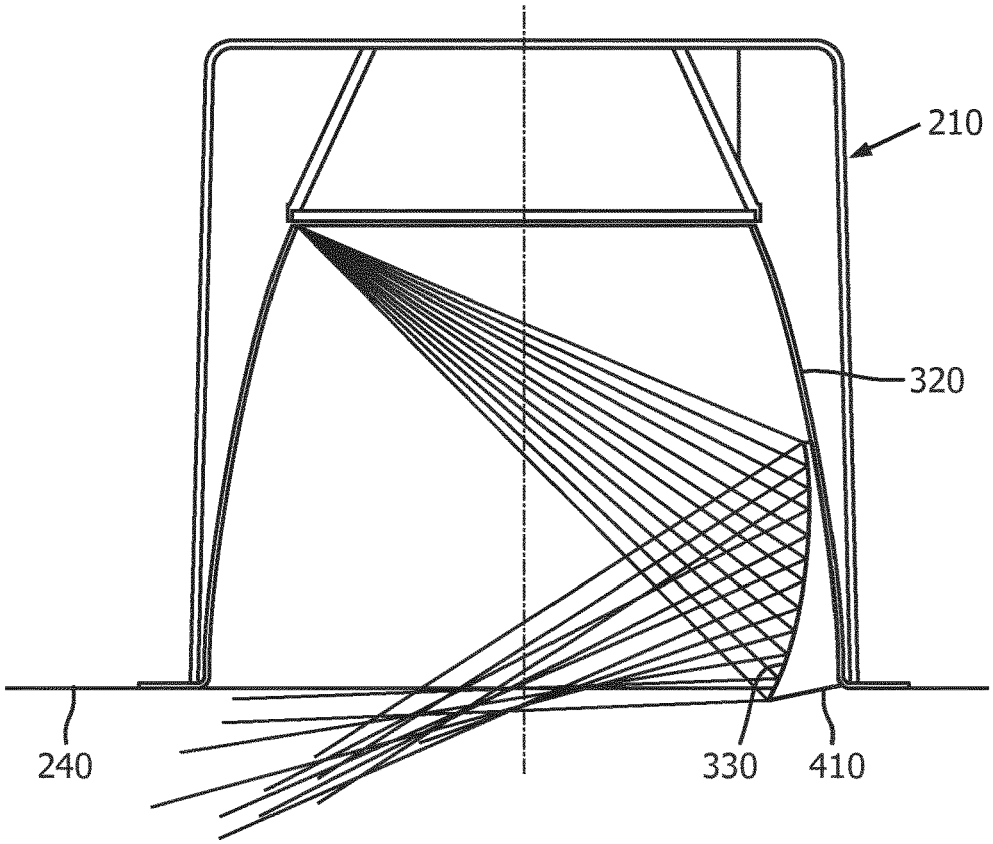
FIG. 4a Prior art
FIG. 4*a* is a perspective view of an exemplary prior art recessed luminaire which provides a kick reflector within the downlight cone.
Figure 4B:
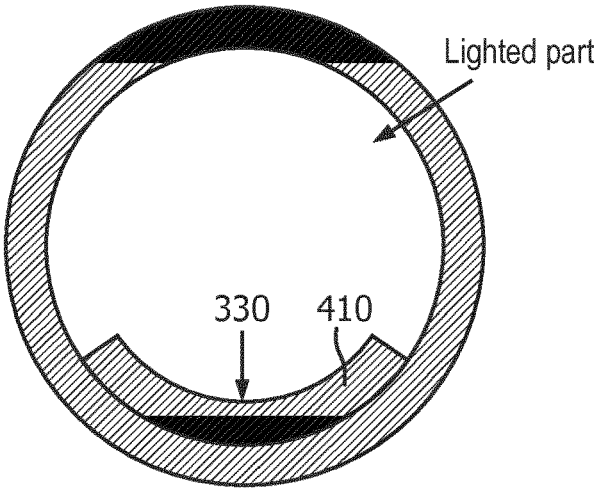
FIG. 4b Prior art
FIG. 4*b* illustrates the light fixture of FIG. 4*a* when viewed from below.
Figure 6A:
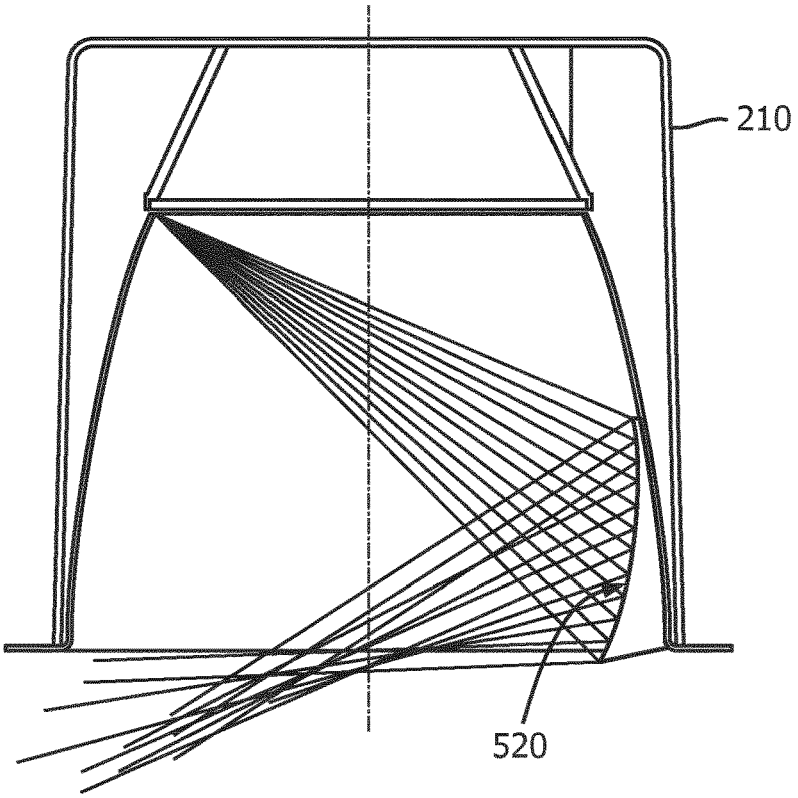
FIGS. 6*a* and 6*b* illustrate light being emitted from the light fixture of FIG. 5.
Figure 6B:
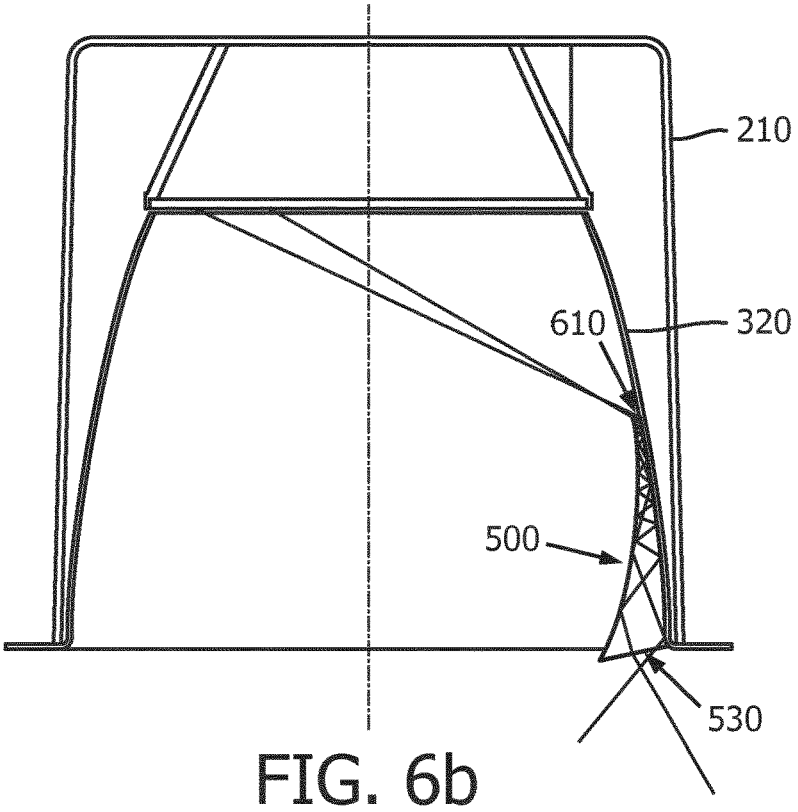

As illustrated in FIG. 6*a*, the front surface 520 of the kick reflector (i.e., the surface facing the interior of the light fixture 210), consisting of a reflective material would direct light toward the wall in a manner similar to that of the prior art (and as illustrated above in FIG. 4*a*). In addition, some light emitted by the light source passes through the top surface 610 of the clear kick reflector material. The clear material then acts as a light guide to allow some light to spill out the bottom surface 530 of the clear material as illustrated in FIG. 6*b*. When light is being emitted by the light source, the downlight cone 320 has some brightness, and the clear material has some brightness. Consequently, the two surfaces visually blend together. As a result, the kick reflector viewable edge 530 is not as noticeable as it would be if it were constructed in the manner taught by the prior art (e.g., as depicted as item 410 of FIGS. 4*a* and 4*b*).

Figure 7:
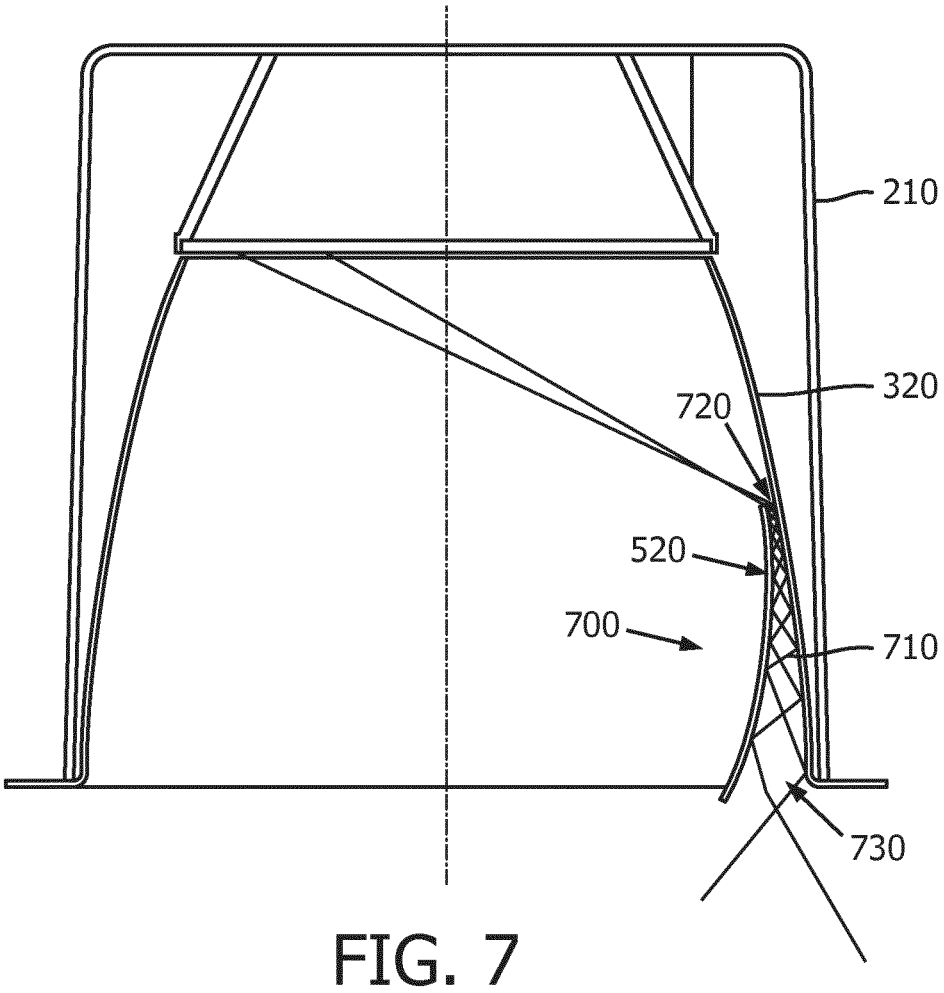
FIG. 7 illustrates and additional embodiment of the invention in which the kick reflector is positioned away from the downlight cone of the luminaire.

In a further embodiment of the invention, depicted in FIG. 7, the kick reflector 700 is more conventional in appearance, not comprising any clear material. Rather, an open air gap 710 is provided behind the kick reflector and the downlight cone 320. The gap at the top 720 is of sufficient size to allow some light behind the kick reflector 700. As illustrated in FIG. 7, this light is then reflected against both the back edge of the reflective front layer 520 of the kick plate and the downlight reflector cone. This results in light being emitted from the gap 730 at the bottom of the kick plate and thus from the luminaire in a manner similar to the emitted light of FIG. 6*b*. The result is also the same the kick reflector is not as noticeable as in the prior art.

Figure 8A:
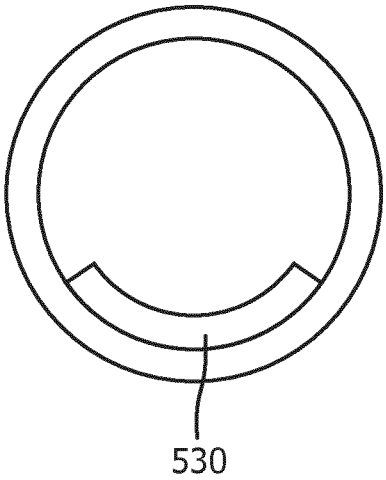
FIGS. 8*a*-8*d* illustrate alternative embodiments of the shape of the bottom edge of the kick reflector.
Figure 8B:
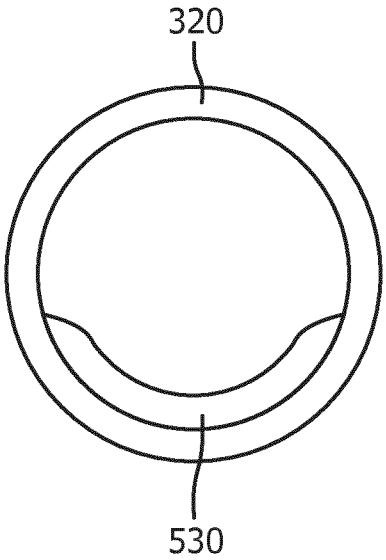
Figure 8C:
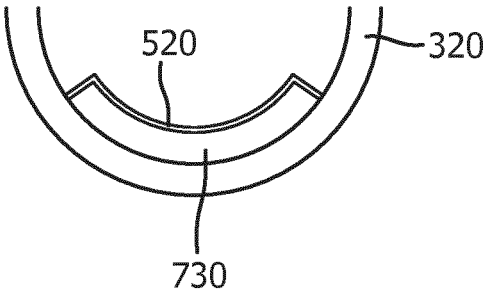
Figure 8D:
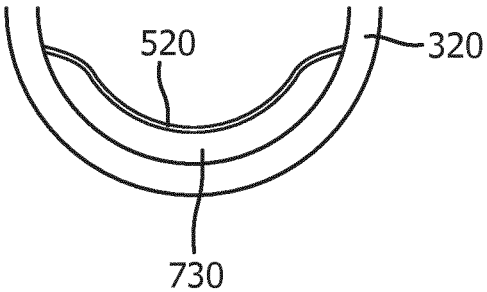

Further embodiments of the invention contemplate that the ends of the kick reflector could be sharp-ended or rounded. By way of examples, FIGS. 8*a* and 8*b* depict various alternative embodiments of the bottom surface 530 of the solid kick reflector as viewed from below. As depicted, the side edges of this bottom surface 530 can be essentially squared-off (FIG. 8*a*) or somewhat rounded (FIG. 8*b*). FIGS. 8*c* and 8*d* illustrate similar shapes that are formed by the reflective front layer 520 of the kick plate when viewed from below. The invention is not so limited, as other alternative shapes are contemplated by the invention.

It should be noted that in use, the bottom of the kick reflector would not appear as pronounced as in FIGS. 8*a*-8*d*.

Figure 9A:
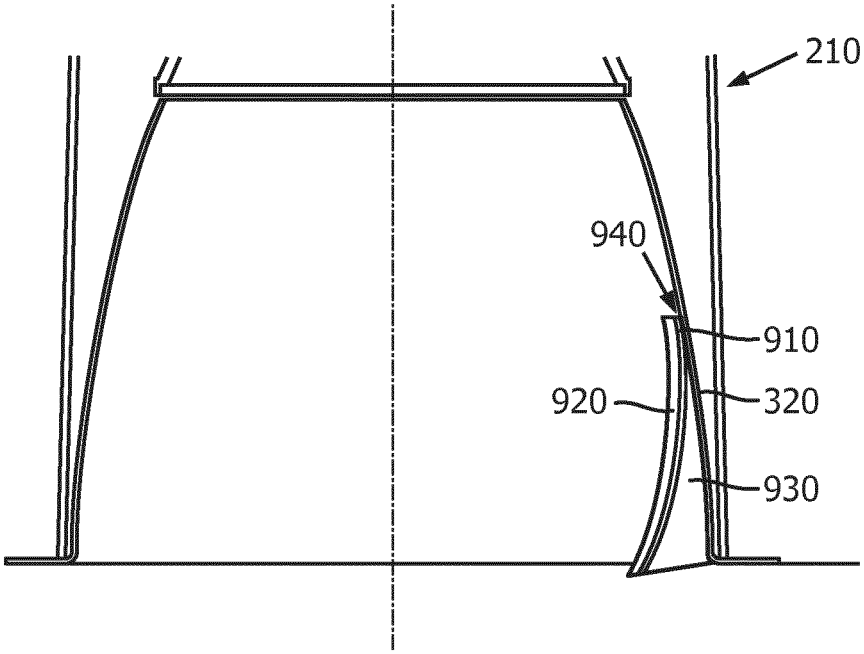
FIGS. 9*a* and 9*b* illustrate alternative embodiments of the invention in which a portion of the kick plate is hollow.
Figure 9B:
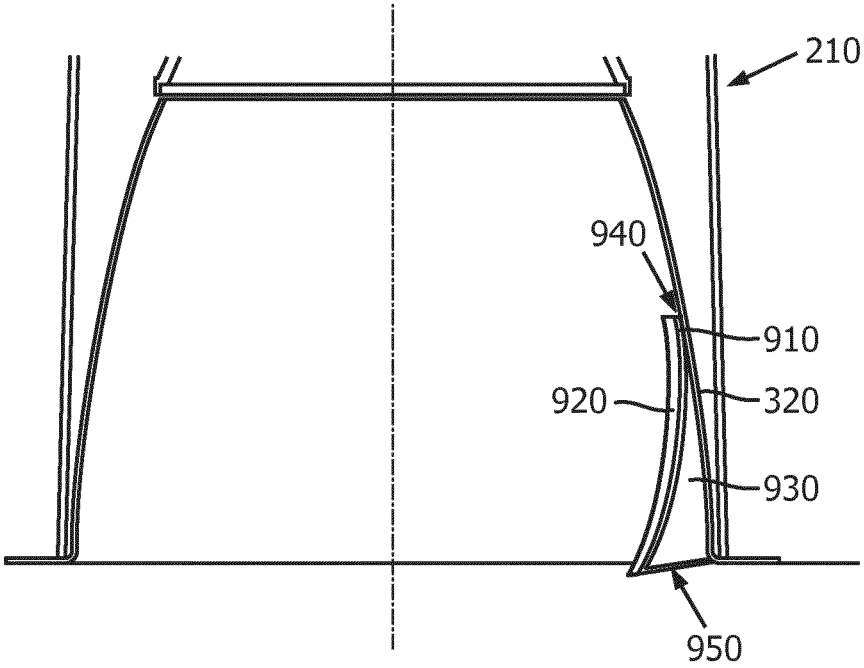

In further embodiments of the invention, depicted in FIGS. 9*a* and 9*b*, the kick plate comprises a solid clear part 910 (e.g. consisting of a clear acrylic), a reflective front layer 920 that is reflective on both sides, and a hollow portion 930 positioned between the solid clear part and the reflector cone 320 of the light fixture. As depicted, the reflective front layer is positioned between the solid clear part 910 and the interior of the lighting fixture such that it does not cover the top portion 940 of the solid clear part, thereby allowing light to pass into the hollow section 930. Further, as illustrated in the embodiments depicted in FIGS. 9*a* and 9*b*, the reflective front layer 920 does not extend across the bottom 950 section of the kick plate, permitting light to readily exit the hollow portion 930.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A luminaire for providing substantially uniform light distribution along a flat wall surface, the luminaire comprising:

a light source;

a housing having an internal reflective surface and an elongated light emitting opening therein in a plane substantially perpendicular to the wall surface to be illuminated; the opening having a center region;

a kick reflector comprising a frontal layer that is reflective on both sides;

wherein at least part of the kick reflector resides within the housing and is positioned between the internal reflective surface and the center region of the housing such that a distance exists between the internal reflective surface of the housing and the frontal layer along the frontal layer's entire length; and, wherein in use, light from the light source passes through said distance between the frontal layer and the housing before being emitted from the light emitting opening at a location between the housing and the frontal layer.

2. The luminaire of claim 1 wherein the kick reflector comprises a clear material that is provided between the frontal layer and the internal reflective surface of the housing, and wherein the clear material has a bottom surface distal the light source.

3. The luminaire of claim 2 wherein the clear material is solid.

4. The luminaire of claim 3 wherein the clear material is a Polymethyl Methacrylate.

5. The luminaire of claim 2 wherein the clear material substantially fills the entire space between the frontal layer and the internal reflective surface of the housing.

6. The luminaire of claim 2 wherein the clear material fills only a portion of the space between the frontal layer and the internal reflective surface of the housing such that a hollow region is formed in the kick reflector, through which hollow region the emitted light passes.

7. The luminaire of claim 1 wherein the kick reflector resides completely within the housing.

8. The luminaire of claim 2 wherein said bottom surface has edges that substantially form 90 degree angles.

9. The luminaire of claim 1 wherein an open air gap exists between the frontal layer and the internal reflective surface of the housing, and the respective reflective surfaces of the frontal layer and the housing result in said light being emitted.

10. The luminaire of claim 9 wherein the frontal layer has a bottom surface and wherein said bottom surface has edges that substantially form 90 degree angles.

11. The luminaire of claim 9 wherein the frontal layer has a bottom surface and wherein said bottom surface has edges that substantially rounded.

12. A luminaire for providing substantially uniform light distribution along a flat wall surface, the luminaire comprising:

a light source;

a housing having an internal reflective surface and an elongated light emitting opening therein in a plane substantially perpendicular to the wall surface to be illuminated; the opening having a center region;

a plurality of kick reflectors, each comprising a frontal layer that is reflective on both sides;

wherein for each of said kick reflectors:

at least part of the kick reflector resides within the housing and is positioned between the internal reflective surface and the center region of the housing such that a distance exists between the housing and the frontal layer along the frontal layer's entire length; and, wherein in use, light from the light source passes through said distance between the frontal layer and the housing before being emitted from the light emitting opening at a location between the housing and the frontal layer.

13. A method for enabling a luminaire to provide substantially uniform light distribution along a flat wall surface; wherein the luminaire comprises a light source, a housing having an internal reflective surface and an elongated light emitting opening therein in a plane substantially perpendicular to the wall surface to be illuminated wherein the opening has a center region, and a kick reflector residing in the housing and comprising a frontal layer that is reflective on both sides; the method comprising:

positioning the kick reflector between the internal reflective surface of the housing and the center region of the housing such that a distance exists between the internal reflective surface of the housing and the frontal layer along the frontal layer's entire length; and, enabling light from the light source to pass through said distance between the frontal layer and the internal reflective surface of the housing before being emitted from the light emitting opening at a location between the housing and the frontal layer.

14. The method of claim 13 wherein the kick reflector comprises a solid clear material that is provided between the frontal layer and the internal reflective surface of the housing, wherein the clear material has a top surface proximate the light source and a bottom surface distal the light source;

wherein said enabling step comprises directing light to enter the top surface and to exit said bottom surface of the clear material.

15. The method of claim 13 wherein the kick reflector comprises a solid clear material that is provided between the frontal layer and the internal reflective surface of the housing, wherein the clear material fills only a portion of the space between the frontal layer and the internal reflective surface of the housing; the method further comprising:

positioning the clear material such that a hollow region is formed between the clear material and the internal reflective surface of the housing; and wherein said enabling step comprises light passing through the hollow region.

* * * * *